United States Patent [19]

Shick

[11] 4,398,829

[45] Aug. 16, 1983

[54] CAN SHAKER KIT FOR ATTACHMENT TO A VIBRATING POWER SANDER

[76] Inventor: Jack N. Shick, 766 Main St., Newington, Conn. 06111

[21] Appl. No.: 281,790

[22] Filed: Jul. 9, 1981

[51] Int. Cl.[3] ..... B01F 11/00

[52] U.S. Cl. ..... 366/110; 366/112; 366/114; 366/605

[58] Field of Search ..... 366/53, 92, 108, 110–112, 366/114–116, 124–126, 128, 208, 209, 210–217, 237, 239, 240, 347, 348, 605; 134/156; 15/94, 97; 51/170 R, 170 MT

[56] References Cited

U.S. PATENT DOCUMENTS 1,365,963 1/1921 Brown et al. ..... 366/210

3,330,537 7/1967 Wason ..... 366/114

3,539,156 11/1970 Zipperer ..... 366/111

*Primary Examiner*—Philip R. Coe

*Assistant Examiner*—Timothy F. Simone

*Attorney, Agent, or Firm*—McCormick, Paulding & Huber

[57] ABSTRACT

A can shaker kit includes a plate an elastomeric strap for holding the can against the plate so that vibratory motion of the sanding base of a vibrating sander is imparted to the can through the plate. Raised ribs are defined in the plate and strap to prevent lateral movement of the can relative to both plate and strap and, cans of various size can be accommodated. The ends of the strap have longitudinally spaced flanges integrally formed therein to secure paint cans of various heights.

2 Claims, 6 Drawing Figures

CAN SHAKER KIT FOR ATTACHMENT TO A VIBRATING POWER SANDER

BACKGROUND OF THE INVENTION

This invention relates generally to shaking apparatus, and deals more particularly with a shaker kit especially adapted for holding paint cans or similar articles against the vibrating base of a conventional orbital sander.

Many machines exist for imparting shaking motion to a can for the purpose of mixing the contents, such as paint, within the can. However, such mixing machines are generally expensive to purchase and may be cost-prohibitive to people who would rarely need such a machine. Vibrating orbital or reciprocating sanders, on the other hand, are relatively inexpensive when compared to the cost of such mixing machines.

It is, therefore, a general object of this invention to provide a low cost kit which, when used with a vibrating orbital or reciprocating sanders, imparts the vibratory motion of the sander's base to a can for mixing the can's contents.

SUMMARY OF THE INVENTION

This invention resides in a kit adapted to hold cans of paint, or the like, against the vibrating base of a vibrating sander.

The kit includes a few relatively inexpensive components which can be used with a vibrating sander to impart vibratory motion of a sanding base to a can. The kit includes plate means fitted to the size and shape of the vibrating base and having raised ribs to receive the can to be shaken. Extensible strap means, also included in the kit, is used to secure the can firmly against the plate means.

DETAILED DESCRIPTION OF THE PREFERRED EMBODIMENT

Figure 1:
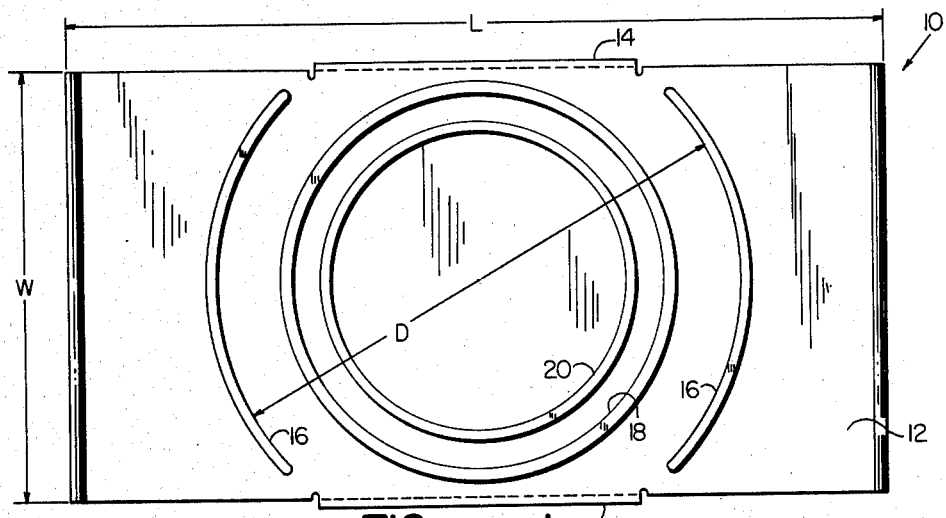
FIG. 1 is a plan view of the plate means provided in a preferred embodiment of this invention.
Figure 2:
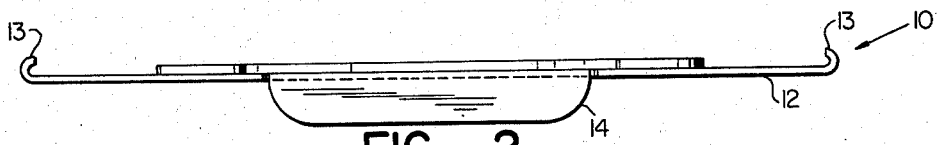
FIG. 2 is a side elevational view of the plate means of FIG. 1.
Figure 5:
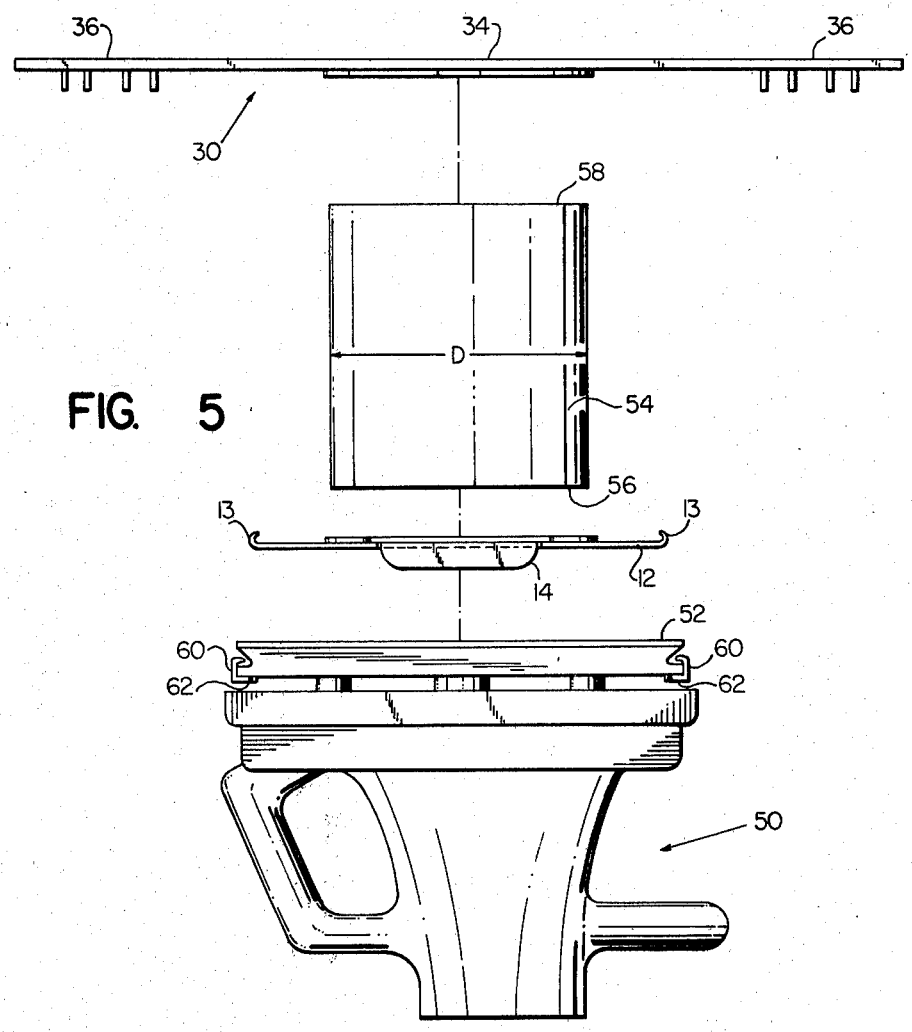
FIG. 5 is an exploded view of the preferred embodiment of this invention showing a vibrating sander, a can to be shaken, and the plate and strap means of FIGS. 1–4.

FIGS. 1 and 2 show plate means of this invention, designated generally at 10. The plate means 10 is in the form of a rectangular plate 12 having two depending flanges 14, 14 positioned on opposite sides of the plate and extending perpendicular to the plane of the of plate. These flanges are so spaced from one another that the plate 12 is adapted to fit to the rectangular sanding base of a conventional power sander as suggested in FIG. 5. The dimensions of the rectangular sanding base of the power sander with which this plate is to be used dictate the plate's dimensions. The width dimension of the sanding base of the sander to be used is equal to the width dimension W of the plate 12 so that the two flanges 14, 14 abut opposite sides of the sanding base when the plate is assembled as shown in FIG. 5. These side flanges 14, 14 engage the sides of the sanding base so that during vibration the plate 12 will not slid laterally relative to the base 52. The length dimension L of the plate 12 is preferably no longer than the length dimension of the sanding base.

In order to best impart vibratory motion of the vibrating sanding base to a can to be shaken and simultaneously protect the felt surface of the base from damage by the can, the plate 12 is rigid and is preferably made of metal. The surface area of the plate is sufficiently large enough to prevent contact between the sanding base surface and the can. As best shown in FIG. 2, opposite edges 13, 13 of the plate 12 are turned upwardly for a reason which will become apparent hereinafter.

The plate 12 has raised ribs 16, 18, 20 which project upwardly out of the plane of the plate for receiving an end of a can to be shaken. Each rib is positioned along the perimeter of a circle having its center corresponding with the center of the plate 12. Because there are a number of ribs having different diameters, the plate can accommodate cans of different diameters. Preferably the ribs snugly engage cans placed upon the plate surface so that the cans are prevented from moving laterally relative to the plate while the sanding base is vibrating.

Figure 3:
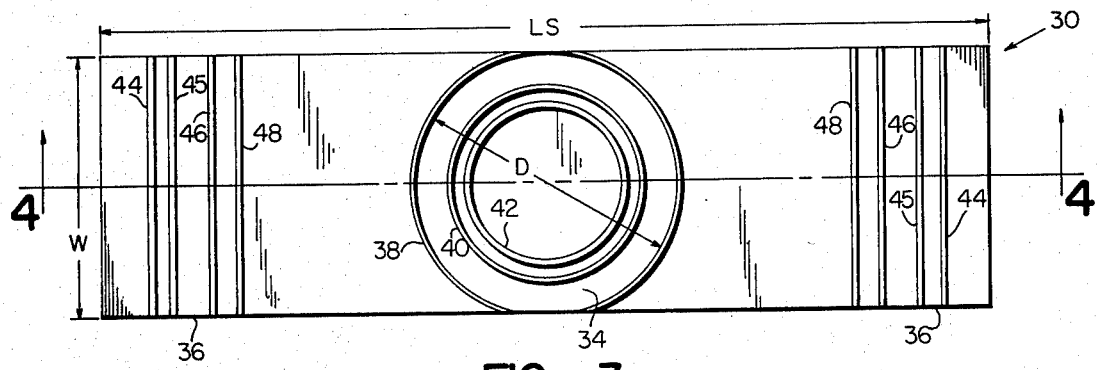
FIG. 3 is a plan view of the extensible strap means included in the preferred embodiment of this invention.
Figure 4:
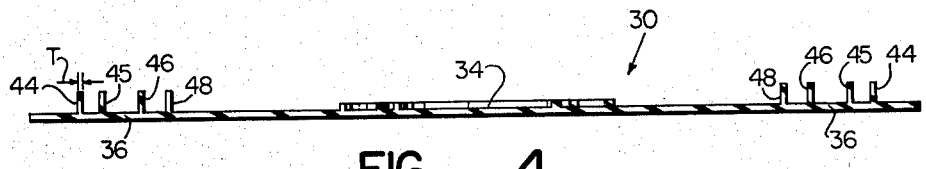
FIG. 4 is a side elevational view of the strap means of FIG. 3.

FIGS. 3 and 4 are two views of an extensible strap means of this invention, generally designated 30. The strap means 30 is preferably in the form of an elastomeric member of width W, but may comprise any resiliently deformable material, such as rubber or a combination of a rigid intermediate portion and extensibly springs. The intermediate portion 34 is preferably planar in its undeformed condition. The elastomeric member 30 has its intermediate portion 34 adapted to engage an opposite end of the can having its one end contacting the plate means 12. Two end portions 36, 36 of the strap 30 serve to connect it to opposite ends of the sanding base. The purpose of the strap member 30 is to secure a can tightly against the plate 12 and it is preferred that the length dimension LS be short enough to require that the it be stretched to secure the end portions 36, 36 to the clamps normally provided at the ends of the sanding base.

The elastomeric member 32 has raised ribs 38, 40, 42 which project outwardly from the plane of the member 30 for receiving the end of the can opposite the end which engages the plate means 10. Each rib is positioned along the perimeter of a circle having its center corresponding with the center of the elastomeric member 32. The number of raised ribs 38, 40, 42, like the raised ribs of the plate 12 of FIGS. 1 and 2, provide means for adapting this member to cans of different diameters. Preferably each rib snugly engages the respective end of the can to prevent relative movement between the can and the member 32 while the base is vibrating. For a can of diameter D the outer ribs 16 and 38 of plate 12 and strap 30 so locate can 54.

Sand paper is commonly held against the base of power sanders by some type of clamping feature which secures opposite ends of the paper to opposite edges of the sanding base. With this clamping feature in mind, the end portions 36, 36 are adapted to be secured to the sanding base as is a piece of sand paper. Each end portion 36, 36 has a plurality of raised ribs 44, 45, 46, 48 projecting outwardly from the plane of the elastomeric member 30 and forming a linear flange across the member 30. The thickness T of each rib, as shown in the cross sectional view of FIG. 4, is no larger than the largest thickness of sand paper capable of being secured to the sanding base. The plurality of ribs on the end portions 36, 36 allow the kit to accommodate cans of different height.

FIG. 5 illustrates in exploded relationship the various components of the kit of this invention and also shows an orbital sander 50. The sander 50 has a vibratory sanding base 52, and this base 52 preferably faces upwardly to facilitate use of the sander as a paint can shaker. The plate 12 of FIGS. 1 and 2 is placed against the face of the sanding base 52 so that its flanges 14, 14 abut opposite sides of the sanding base. A can 54 to be shaken is placed atop the plate 12 so that its lower end 56 is received within a raised rib of the plate 12. The elastomeric member 30 of FIGS. 3 and 4 is placed across the upper end 58 of the can 54 so that the upper end is received within a raised rib 38 of the intermediate portion 34 of strap 30.

Figure 6:
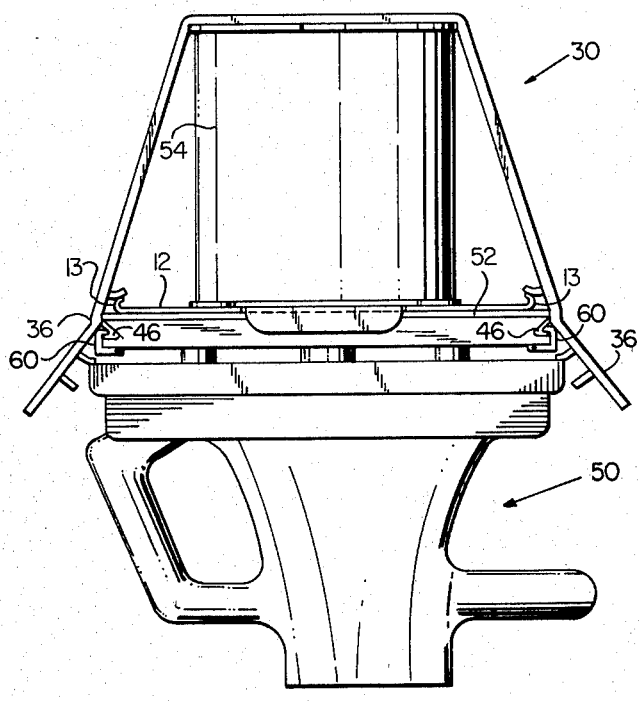
FIG. 6 is a view side elevational of the FIG. 5 items in assembled relationship.

The member 30 is stretched out lengthwise so that its ends can be connected to the base 52 as shown in FIG. 6. A raised rib 46 of each of the strap member end portions 36, 36 is securely fastened within the space provided at the sand paper clamping means 60, 60 of the sanding base 52. Each clamp 60 is pivotally mounted to the base as shown at 62, and is spring biased toward the position shown. Each clamp 60 can be pivoted outwardly away from the base 52 so as to permit insertion of a sheet of sand paper or one of the ribs 46 on the strap 30 as shown in FIG. 6. Since the elastomeric member 30 is stretched to a deformed condition to enable its end portions to be so connected to the sanding base, the elastomeric member 30 effectively presses the can 54 against the plate 12, and the sanding base, with sufficient force so that vibratory motion of the sanding base is imparted to the can 54 to be shaken. As best shown in the arrangement of FIG. 6, the upturned edges 13, 13 of the plate 12 effectively blunt the respective edges of the plate so that the elastomeric member 30 cannot be worn or cut by the plate edges. The plate itself being of metal serves to protect the soft pad of the base 52 from the vibrating paint can 54.

I claim:

1. A can shaker kit for attachment to the rectangular sanding base of an inverted vibratory sander, which base has clamping means at the opposite shorter sides thereof, said kit comprising a rectangular plate having depending side flanges abutting the longer sides of the sander base to prevent movement of the plate laterally, said plate having raised ribs so positioned as to locate cans to be shaken in centered relationship and in upright condition on said plate, said plate having upturned ends along its shorter sides, an elastomeric strap of elongated rectangular shape with ends of approximately the same width as said plate shorter sides, said strap having ribs integrally formed in said strap and corresponding to those in said plate and having integrally formed longitudinally spaced laterally extending flanges selected pairs of which are adapted to be received by said clamping means to secure cans of various height between said strap and said plate for shaking as a result of longitudinally stretching said strap so that it biases a can toward said plate and so that portions of said strap adjacent said clamp strap flanges abut said upturned ends of said plate to restrict said plate from movement longitudinally of said sandere base.

2. The combination of claim 1 wherein said can shaker kit consists of said plate and said elastomeric strap only.

* * * * *